US010226656B2

(12) United States Patent
Frasure et al.

(10) Patent No.: US 10,226,656 B2
(45) Date of Patent: Mar. 12, 2019

(54) AUTOMATIC FIRE EXTINGUISHER SYSTEM HAVING A SAFETY ASSEMBLY

(71) Applicant: Kidde Technologies, Inc., Wilson, NC (US)

(72) Inventors: David William Frasure, Wilson, NC (US); Doug John Baxendell, Clayton, NC (US); Christopher Wilson, Wake Forest, NC (US); Terry Simpson, Wake Forest, NC (US); John Wright Porterfield, Jr., Raleigh, NC (US); Kevin R. Leitch, Raleigh, NC (US); Michael Lee Davis, Wilson, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 217 days.

(21) Appl. No.: 15/076,714

(22) Filed: Mar. 22, 2016

(65) Prior Publication Data

US 2017/0274233 A1 Sep. 28, 2017

(51) Int. Cl.

| | |
|---|---|
| ***A62C 35/68*** | (2006.01) |
| ***A62C 35/02*** | (2006.01) |
| ***A62C 35/13*** | (2006.01) |
| *A62C 3/07* | (2006.01) |

(52) U.S. Cl.

CPC ..... *A62C 35/023* (2013.01); *A62C 35/13* (2013.01); *A62C 35/68* (2013.01); *A62C 3/07* (2013.01)

(58) Field of Classification Search

CPC ..... A62C 35/023; A62C 35/13; A62C 35/68; A62C 3/07; F16K 35/02; F16K 35/027; F16K 35/14; F16K 3/00–3/36; F16K 35/00–35/16

USPC ..... 251/149.9; 137/614.06; 169/26, 29

See application file for complete search history.

(56) References Cited

U.S. PATENT DOCUMENTS

| | | | | |
|---|---|---|---|---|
| 2,972,466 | A | 2/1961 | Allen et al. | |
| 3,980,270 | A | 9/1976 | Thomas | |
| 6,029,947 | A | 2/2000 | Sears | |
| 2008/0290310 | A1 | 11/2008 | Unrath | |
| 2015/0114471 | A1* | 4/2015 | Draper | F16K 3/02 137/1 |
| 2015/0144361 | A1 | 5/2015 | Kluz et al. | |

FOREIGN PATENT DOCUMENTS

| | | | |
|---|---|---|---|
| EP | 1661603 | A1 | 5/2006 |
| GB | 2408684 | A | 6/2005 |

OTHER PUBLICATIONS

European Search Report for European Application No. 17162223.6 dated Aug. 1, 2017, 7 pages.

* cited by examiner

*Primary Examiner* — Darren W Gorman
*Assistant Examiner* — Juan C Barrera
(74) *Attorney, Agent, or Firm* — Cantor Colburn LLP

(57) ABSTRACT

A safety assembly provided with an automatic fire extinguisher system includes an engagement member, a blocking member, and an extension member. The engagement member is slidably received within an outlet port of a valve housing. A blocking member having a first blocking member portion and a second blocking member portion is at least partially received within a cavity defined by the valve housing. The extension member extends between the engagement member and the blocking member.

11 Claims, 3 Drawing Sheets

AUTOMATIC FIRE EXTINGUISHER SYSTEM HAVING A SAFETY ASSEMBLY

BACKGROUND

The present disclosure relates to an automatic fire extinguisher system having a safety assembly.

Automatic fire extinguisher systems rapidly disperse extinguishing agents within a confined space following a thermal event. Automatic fire extinguisher systems include a pressurized extinguishing agent that is rapidly deployed within the confined space.

BRIEF DESCRIPTION

According to an embodiment of the present disclosure, an automatic fire extinguisher system is provided. The automatic fire extinguisher system includes a valve housing, an extinguisher bottle, a valve assembly, and a safety assembly. The valve housing has an inlet port in fluid communication with an outlet port. The valve housing has a safety block disposed opposite the outlet port. The extinguisher bottle is configured to receive an extinguishing agent and is in fluid communication with the inlet port. The valve assembly is movable between a closed position in which the valve assembly inhibits fluid communication between the inlet port and the outlet port and an open position in which the valve assembly permits fluid communication between the inlet port and the outlet port. The safety assembly is disposed within the valve housing. The safety assembly is movable between a safe position in which the safety assembly inhibits movement of the valve assembly from the closed position towards the open position and an armed position in which the safety assembly permits movement of the valve assembly from the closed position towards the open position. The safety assembly includes an engagement member slidably disposed within the outlet port, a blocking member at least partially disposed within the safety block, and an extension member that extends between the engagement member and the blocking member.

According to another embodiment of the present disclosure, an automatic fire extinguisher system is provided. The automatic fire extinguisher system includes a valve housing and a safety assembly. The valve housing has an inlet port, an outlet port, an opening, and a cavity. The valve housing receives a valve assembly movable between a closed position in which the valve assembly inhibits fluid communication between the inlet port and the outlet port and an open position in which the valve assembly permits fluid mitigation between the inlet port and the outlet port. The safety assembly is disposed within the valve housing. The safety assembly includes a blocking member having a first blocking member portion and a second blocking member portion that extends through the opening and into the cavity. The blocking member is movable between an extended position in which the first blocking member portion inhibits the valve assembly from moving from the closed position towards the open position and a retracted position in which the first blocking member portion permits the valve assembly to move from the closed position towards the open position.

According to yet another embodiment of the present disclosure, a safety assembly provided with an automatic fire extinguisher system is provided. The safety assembly includes an engagement member, a blocking member, and an extension member. The engagement member is slidably received within an outlet port of a valve housing. A blocking member having a first blocking member portion and a second blocking member portion is at least partially received within a cavity defined by the valve housing. The extension member extends between the engagement member and the blocking member.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Referring now to the Figures, where the present disclosure will be described with reference to specific embodiments, without limiting same, it is to be understood that the disclosed embodiments are merely illustrative of the present disclosure that may be embodied in various and alternative forms. Various elements of the disclosed embodiments may be combined or omitted to form further embodiments of the present disclosure. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Throughout this specification, the term "attach," "attachment," "connected", "coupled," "coupling," "mount," or "mounting" shall be interpreted to mean that a structural component or element is in some manner connected to or contacts another element, either directly or indirectly through at least one intervening structural element, or is integrally formed with the other structural element.

Figure 1:
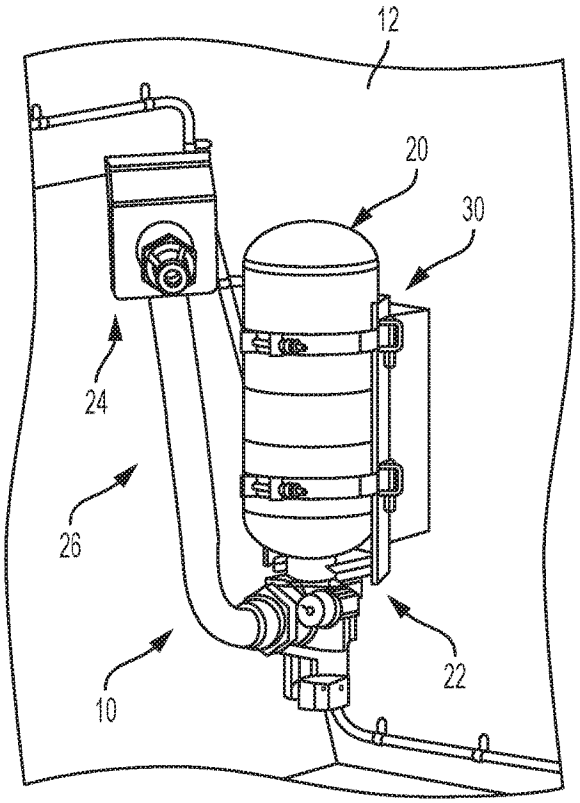
FIG. 1 is a perspective view of an automatic fire extinguisher system disposed within a confined space.

Referring to FIG. 1, an automatic fire extinguisher system 10 is shown installed within a confined space 12. The confined space 12 may be a crew compartment, engine compartment, or the like, of a vehicle. The automatic fire extinguisher system 10 includes an extinguisher bottle 20 connected to a valve housing 22 that is fluidly connected to a discharge housing 24 by an exit hose 26.

The extinguisher bottle 20 is fixedly disposed within the confined space 12 by a bracket assembly 30. The extinguisher bottle 20 receives a pressurized fire suppression material or a pressurized extinguishing agent. The extinguisher bottle 20 is connected to the valve housing 22. Responsive to a thermal event within the confined space 12, the valve housing 22 enables the extinguisher bottle 20 to release the pressurized extinguishing agent. The extinguishing agent is delivered through the exit hose 26 and is dispersed within the confined space 12 through the discharge housing 24.

A valve disposed within the valve housing 22 reacts within 10 ms of activation and 90% of the contents of the extinguisher bottle 20 are emptied within 175 ms. The extinguishing agent may be discharged from the extinguisher bottle 20 whether opened electrically, manually, or due to shock encountered by the automatic fire extinguishing system 10 greater than a threshold. Transportation and handling of the extinguisher bottle 20 should be performed with care to avoid the unintentional release of the extinguishing agent due to shock.

Figure 2:
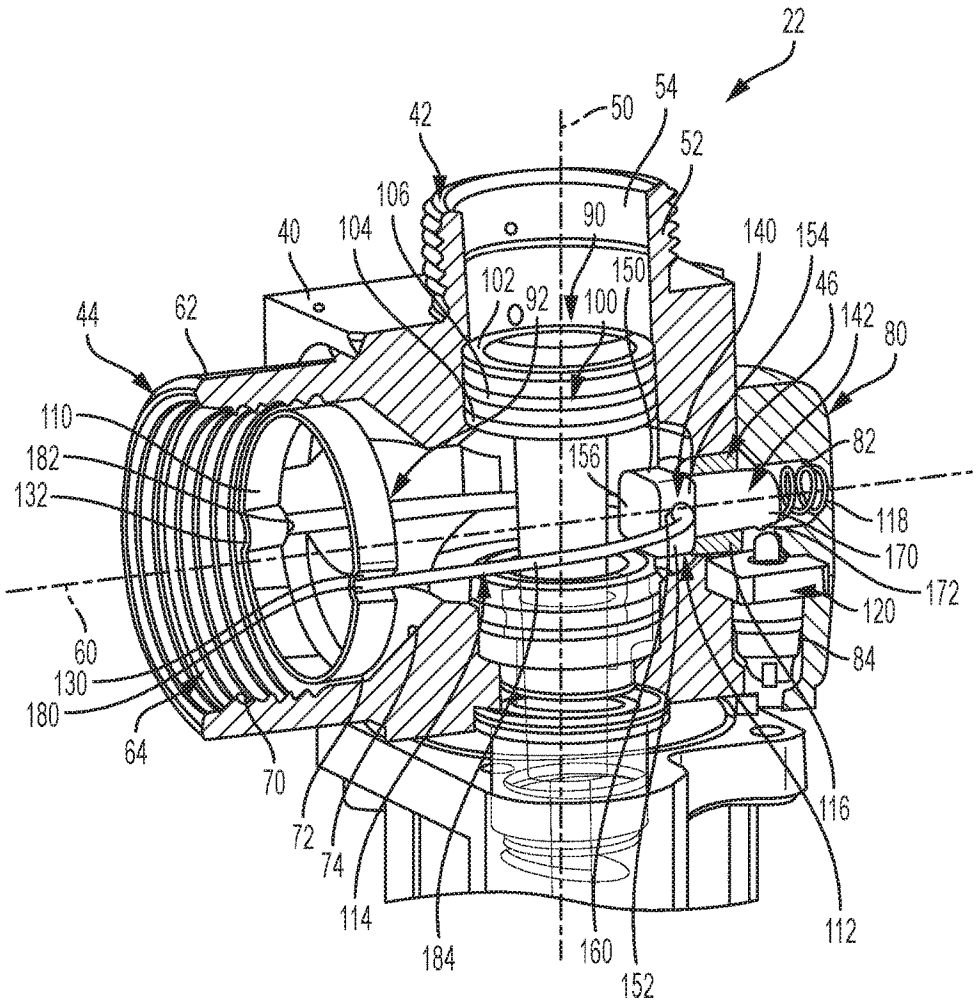
FIG. 2 is a perspective view of a valve housing having a safety assembly of the automatic fire extinguisher system.

Referring to FIG. 2, the valve housing 22 includes a valve body 40 that defines an inlet port 42, an outlet port 44, and an opening 46. The inlet port 42 is configured to fluidly connect the extinguisher bottle 20 to the valve housing 22. The inlet port 42 extends along a first axis 50. The inlet port 42 includes an exterior surface 52 provided with a plurality of exterior threads and an interior surface 54 disposed opposite the exterior surface 52. The interior surface 54 is a substantially smooth surface. The inlet port 42 has an inlet port diameter.

The outlet port 44 extends along a second axis 60. The second axis 60 is disposed substantially transverse to the first axis 50. The outlet port 44 has an outlet port diameter that is greater than the inlet port diameter.

The outlet port 44 includes an exterior surface 62 and an interior surface 64 disposed opposite the exterior surface 62. The exterior surface 62 is substantially smooth. The interior surface 64 includes a first portion 70, a second portion 72, and a third portion 74. The first portion 70 is provided with a plurality of interior threads that extend from an end of the outlet port 44 towards the valve body 40. The second portion 72 is substantially smooth. The second portion 72 extends between the first portion 70 and the third portion 74. The third portion 74 is substantially smooth. The third portion 74 includes a pair of tapered walls 76 that each become progressively closer to each other in a direction that extends towards the valve body 40.

The opening 46 is disposed opposite the outlet port 44. The opening 46 extends along the second axis 60. The opening 46 has an opening diameter. The opening diameter is less than the inlet port diameter.

The valve housing 22 includes a safety block 80. The safety block 80 may be integrally formed with the valve housing 22 or may be provided as a separate component that is attached to the valve housing 22. The safety block 80 defines a cavity 82 and a transverse opening 84.

The cavity 82 extends along the second axis 60. The cavity 82 of the safety block 80 is proximately aligned with the opening 46 of the valve body 40. The transverse opening 84 is disposed substantially transverse to the cavity 82 and the opening 46. The transverse opening 84 is disposed along an axis that is spaced apart from and disposed substantially parallel to the first axis 50.

The valve housing 22 is provided with a valve assembly 90 and a safety assembly 92 to mitigate or inhibit the unintentional release of the extinguishing agent not in response to a thermal event within the confined space 12. The valve assembly 90 is slidably disposed within the valve body 40 of the valve housing 22.

The valve assembly 90 includes a valve 100 that is slidably disposed within the inlet port 42. The valve 100 includes a top surface 102, a bottom surface 104 disposed opposite the top surface 102, and an exterior surface extending between the top surface 102 and the bottom surface 104. The exterior surface of the valve 100 engages the interior surface 54 of the inlet port 42. The valve 100 is configured as a poppet valve.

The valve 100 of the valve assembly 90 is movable between a closed position and an open position along a path of travel that is disposed substantially parallel to or coaxial with the first axis 50. The closed position inhibits fluid communication between the inlet port 42 and the outlet port 44 such that the extinguishing agent of the extinguisher bottle 20 is unable to be discharged through the outlet port 44. The open position permits fluid communication between the inlet port 42 and the outlet port 44 such that the extinguishing agent of the extinguisher bottle 20 is able to be discharged through the outlet port 44.

The safety assembly 92 is disposed within the valve housing 22. The safety assembly 92 is configured to inhibit movement of the valve 100 of the valve assembly 90 from the closed position towards the open position when the safety assembly 92 is in a safe position. The safety assembly 92 is configured to permit movement of the valve 100 of the valve assembly 90 from the closed position towards the open position when the safety assembly is in an armed position.

The safety assembly 92 includes an engagement member 110, a blocking member 112, an extension member 114, a bushing 116, a biasing member 118, and an indicator 120. The engagement member 110 is slidably received within the outlet port 44. The engagement member 110 is disposed between the first portion 70 and the third portion 74 of the interior surface 64 of the outlet port 44. The engagement member 110 is shaped to conform to the shape of interior surface 64 of the outlet port 44. In at least one embodiment, the engagement member 110 is configured as a ring.

The engagement member 110 defines a first engagement feature 130 and a second engagement feature 132. The first engagement feature 130 is radially spaced apart from the second engagement feature 132. The first engagement feature 130 and the second engagement feature 132 are configured as notches or tabs that extend towards a center of the engagement member 110.

The blocking member 112 is received within the valve housing 22. The blocking member 112 at least partially extends through the opening 46 and is at least partially received within the cavity 82 of the safety block 80. The blocking member 112 includes a first blocking member portion 140 and a second blocking member portion 142.

The first blocking member portion 140 includes a first surface 150, a second surface 152, a first side surface 154, and a second side surface 156. The first surface 150 faces towards the bottom surface 104 of the valve 100 of the valve assembly 90. The second surface 152 is disposed opposite the first surface 150. The first side surface 154 extends between the first surface 150 and the second surface 152. The second side surface 156 is disposed opposite the first side surface 154. The second side surface 156 extends between the first surface 150 and the second surface 152.

The first blocking member portion 140 defines a through hole 160. The through hole 160 extends from the first side surface 154 to the second side surface 156.

The second blocking member portion 142 includes a blocking body 170 that extends away from the first blocking member portion 140. The blocking body 170 of the second blocking member portion 142 extends through the bushing 116 that is disposed within the opening 46 of the valve body 40 and is at least partially received within the cavity 82 of the safety block 80. The blocking body 170 includes a protrusion 172. The protrusion 172 is configured as a bump, ramp, protuberance, or the like, that extends away from the blocking body 170 along an axis that is disposed substantially parallel to the first axis 50.

The blocking member 112 is movable between an extended position and a retracted position. The extended position of the blocking member 112 corresponds to the safe position of the safety assembly 92 in which the first blocking member portion 140 extends into the path of travel of the valve 100 of the valve assembly 90. The first blocking member portion 140 inhibits the valve 100 of the valve assembly 90 from moving from the closed position to the open position. In at least one embodiment, while the blocking member 112 is in the extended position, the first surface 150 of the first blocking member portion 140 is configured to engage the bottom surface 104 of the valve 100 of the valve assembly 90 to inhibit the valve 100 of the valve assembly 90 from moving towards the open position to inhibit a fluid connection between the inlet port 42 and the outlet port 44.

The retracted position of the blocking member 112 corresponds to the armed position of the safety assembly 92 in which the first blocking member portion 140 is spaced apart from the path of travel of the valve 100 of the valve assembly 90. The retracted position of the blocking member 112 permits the valve 100 of the valve assembly 90 to move from the closed position towards the open position to fluidly connect the inlet port 42 to the outlet port 44.

The extension member 114 extends between the engagement member 110 and the blocking member 112. The extension member 114 extends about and is spaced apart from the valve assembly 90. The extension member 114 includes a first end 180, a second end 182, and a loop 184 extending between the first end 180 and the second end 182. The first end 180 is coupled to the first engagement feature 130. The second end 182 is coupled to the second engagement feature 132. The loop 184 is received within and extends through the through hole 160 of the first blocking member portion 140 of the blocking member 112.

The bushing 116 is disposed within the opening 46 of the valve body 40 of the valve housing 22. The bushing 116 includes a bushing opening. The blocking body 170 of the second blocking member portion 142 of the blocking member 112 extends through the bushing opening. In at least one embodiment, the bushing 116 is disposed about the blocking body 170 of the second blocking member portion 142 of the blocking member 112 extends through the bushing opening.

The biasing member 118 is disposed within the cavity 82 of the safety block 80. The biasing member 118 is configured to engage an end wall of the cavity 82 of the safety block 80 and an end of the second blocking member portion 142 of the blocking member 112. The biasing member 118 biases the blocking member 112 towards the extended position. The biasing of the blocking member 112 towards the extended position biases the safety assembly 92 towards the safety position.

The indicator 120 is received within the transverse opening 84 of the safety block 80. The indicator 120 extends through at least a portion of the cavity 82 of the safety block 80. The indicator 120 is disposed proximate the protrusion 172 of the blocking body 170 of the second blocking member portion 142 of the blocking member 112. The indicator 120 is configured as a switch that is in communication with a control system or monitoring system. The indicator 120 is configured to provide a signal to the control system or monitoring system indicative of whether the safety assembly 92 is in the safe position or the armed position.

The protrusion 172 is spaced apart from the indicator 120 while the blocking member 112 is in the extended position. The control system or monitoring system outputs an indicator indicative of the safety assembly 92 being in a safe position, in response to the non-engagement between the protrusion 172 and the indicator 120. The protrusion 172 engages the indicator 120 while the blocking member 112 is moving towards or is in the retracted position. The control system or monitoring system outputs an indicator indicative of the safety assembly 92 being in an armed position, in response to the engagement between the protrusion 172 and indicator 120.

Figure 3:
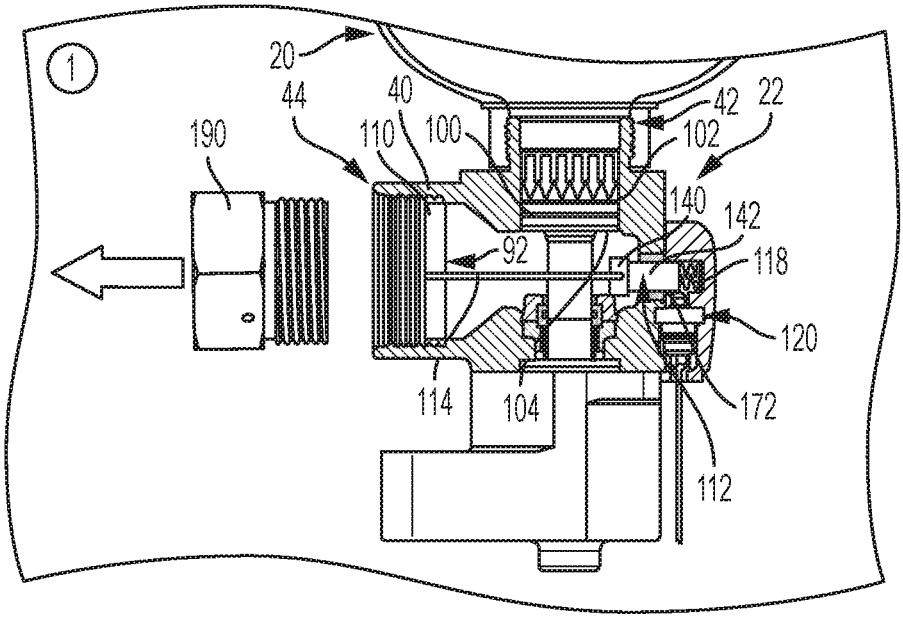
FIG. 3 is a side view of a valve assembly in a closed position and the safety assembly in a safe position prior to installation of an exit hose.

The safety assembly 92 may be moved from the safe position towards the armed position following an installation procedure as illustrated by FIGS. 3-6. As shown in FIG. 3, an anti-recoil plug 190 that is installed onto the outlet port 44 of the valve housing 22 is removed. The anti-recoil plug 190 enables the combination of the extinguisher bottle 20 and the valve housing 22 to be installed onto the bracket assembly 30 disposed within or on a surface of the confined space 12 while inhibiting a potential discharging of the extinguishing agent. After installation of the extinguisher bottle 20 and the valve housing 22 onto the bracket assembly 30, the valve 100 of the valve assembly 90 is in the closed position and the safety assembly 92 is in the safe position. The pressurized extinguishing agent pushes down on the top surface 102 of the valve 100 of the valve assembly 90 however the valve assembly 90 is inhibited from moving from the closed position towards the open position.

Figure 4:
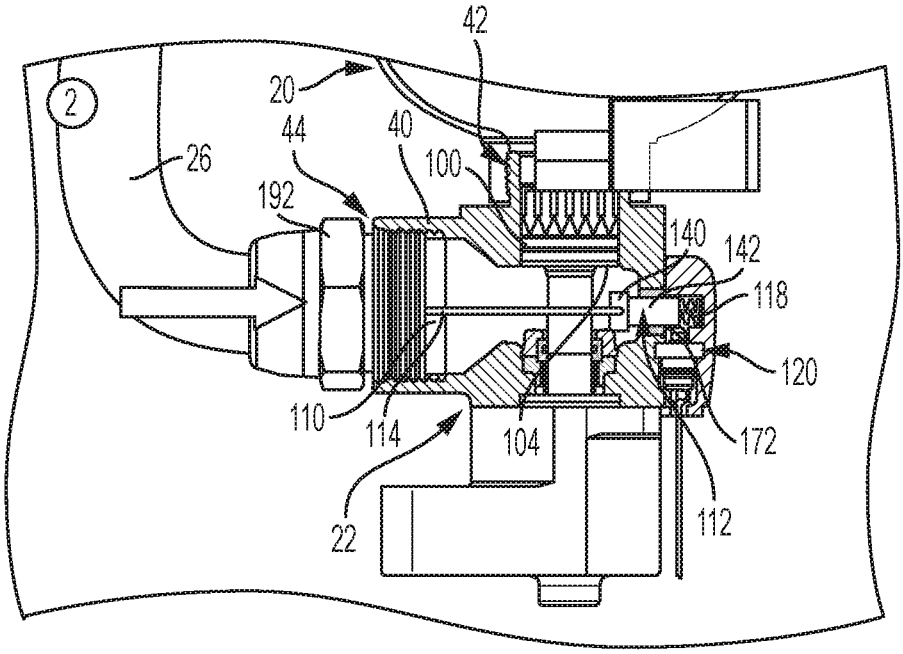
FIG. 4 is a side view of the valve assembly in the closed position and the safety assembly moving from the safe position towards the armed position during installation of the exit hose.

As shown in FIG. 4, a fitting 192 that is attached to an end of the exit hose 26 is inserted into the outlet port 44 of the valve housing 22. As the fitting 192 is threaded into the outlet port 44 of the valve housing 22, an end of the fitting 192 engages the engagement member 110 of the safety assembly 92. The continued engagement between the end of the fitting 192 and the engagement member 110 of the safety assembly 92 begins to translate the safety assembly 92 from the safe position towards the armed position. As the engagement member 110 translates towards the safety block 80, the extension member 114 that is connected to the engagement member 110 moves the blocking member 112 from the extended position towards the retracted position. The valve 100 of the valve assembly 90 is in the closed position and the safety assembly 92 is in the safe position, in which the first blocking member portion 140 is disposed within the path of travel of the valve 100 of the valve assembly 90.

Figure 5:
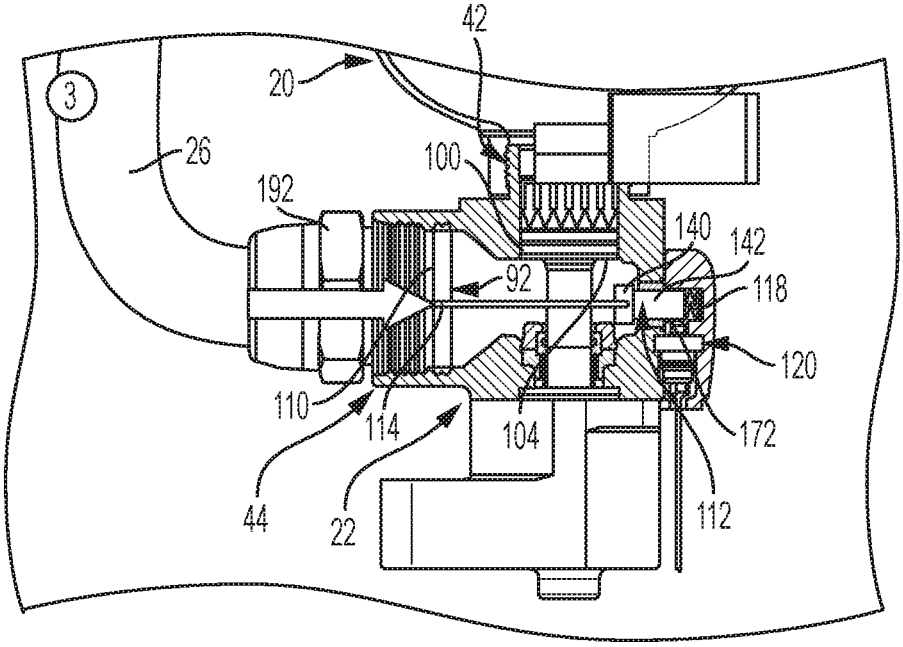
FIG. 5 is a side view of the valve assembly in the closed position and the safety assembly in the armed position after installation of the exit hose.

As shown in FIG. 5, as the fitting 192 continues to be threaded into the outlet port 44, the end of the fitting 192 translates the safety assembly 92 towards the armed position. As the engagement member 110 translates towards the safety block 80, the extension member 114 that is connected to the engagement member 110 moves the blocking member 112 from the extended position further towards the retracted position. Responsive to the blocking member 112 being disposed proximate the retracted position, the protrusion 172 of the blocking body 170 of the second blocking member portion 142 of the blocking member 112 may engage the indicator 120. The valve 100 of the valve assembly 90 is in the closed position and the safety assembly 92 is in the safe position, in which the first blocking member portion 140 is disposed within the path of travel of the valve assembly 90.

Figure 6:
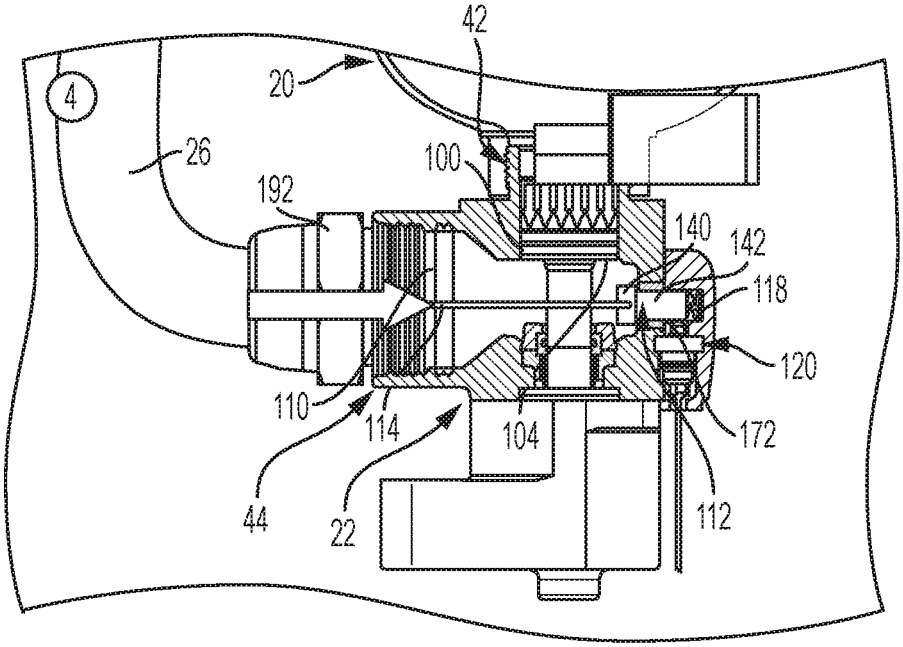
FIG. 6 is a side view of the valve assembly moving from the closed position towards the open position and the safety assembly in the armed position after installation of the exit hose.

As shown in FIG. 6, the substantial threading of the fitting 192 into the outlet port 44 of the valve housing 22, the end of the fitting 192 translates the safety assembly 92 to the armed position. The extension member 114 that is connected to the engagement member 110 moves the blocking member 112 from the extended position to the retracted position. Responsive to the engagement between the protrusion 172 and the indicator 120, the indicator 120 outputs a signal indicative of the safety assembly 92 achieving the armed position. The valve assembly 90 is in the closed position and the safety assembly 92 is in the armed position, in which the first blocking member portion 140 of the blocking member 112 is spaced apart from the path of travel of the valve 100 of the valve assembly 90, enabling the valve 100 of the valve assembly 90 to move from the closed position towards the open position in response to a thermal event within the confined space 12.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. An automatic fire extinguisher system, comprising:

a valve housing that defines an inlet port, an outlet port, an opening, and a cavity, the valve housing receives a valve assembly movable between a closed position in which the valve assembly inhibits fluid communication between the inlet port and the outlet port and an open position in which the valve assembly permits fluid communication between the inlet port and the outlet port; and a safety assembly disposed within the valve housing, the safety assembly includes:

a blocking member that includes a first blocking member portion and a second blocking member portion that extends through the opening and into the cavity, the blocking member movable between an extended position in which the first blocking member portion inhibits the valve assembly from moving from the closed position to the open position and a retracted position in which the first blocking member permits the valve assembly to move from the closed position to the open position;

an engagement member slidably received within the outlet port; and an extension member is connected to a first engagement feature of the engagement member and extends at least partially through the first blocking member portion.

2. The automatic fire extinguisher system of claim 1, wherein the safety assembly further includes:

a bushing disposed within the opening, and a biasing member disposed within the cavity, wherein the second blocking member portion extends through the bushing and engages the biasing member.

3. A safety assembly provided with an automatic fire extinguisher system, the safety assembly comprising:

an engagement member slidably disposed within an outlet port of a valve housing;

a blocking member having a first blocking member portion and a second blocking member portion that is at least partially disposed within a cavity defined by the valve housing; and an extension member having a first end and a second end coupled to the engagement member and a loop extending between the first end and the second end, at least a portion of the loop extending through the first blocking member portion.

4. The safety assembly of claim 3, further comprising:

a biasing member disposed within the cavity, the biasing member engages an end of the second blocking member portion.

5. The safety assembly of claim 4, wherein the biasing member biases the blocking member towards an extended position in which the first blocking member portion is disposed within a path of travel of a valve assembly disposed within the valve housing.

6. The safety assembly of claim 5, wherein the second blocking member portion includes a protrusion that is spaced apart from the end of the second blocking member portion.

7. The safety assembly of claim 6, further comprising an indicator that extends through the valve housing.

8. The safety assembly of claim 7, wherein the protrusion is spaced apart from the indicator while the blocking member is in the extended position.

9. The safety assembly of claim 7, wherein the protrusion engages the indicator while the blocking member is in a retracted position in which the first blocking member portion is spaced apart from the path of travel of the valve assembly.

10. The safety assembly of claim 4, further comprising a bushing disposed about the second blocking member portion.

11. The safety assembly of claim 10, wherein the bushing is disposed within an opening defined by the valve housing and spaced apart from the cavity.

* * * * *